US005779055A

United States Patent [19]

Lacy, III

[11] Patent Number: 5,779,055

[45] Date of Patent: Jul. 14, 1998

[54] PROTECTIVE PACKAGE FOR DELICATE ITEMS

[75] Inventor: Curtis R. Lacy, III, Buford, Ga.

[73] Assignee: Stephen Gould Paper Co., Inc., Whippany, N.Y.

[21] Appl. No.: 811,857

[22] Filed: Mar. 5, 1997

Related U.S. Application Data

[63] Continuation of Ser. No. 422,070, Apr. 13, 1995, abandoned.

[51] Int. Cl.[6] ..... B65D 85/30

[52] U.S. Cl. ..... 206/701; 206/521

[58] Field of Search ..... 206/701, 722, 206/724, 521, 591, 592, 594

[56] References Cited

U.S. PATENT DOCUMENTS

| | | | |
|---|---|---|---|
| 1,720,889 | 7/1929 | Eshleman | 206/594 X |
| 2,370,749 | 3/1945 | Perkins | 206/594 X |
| 3,057,468 | 10/1962 | Allan, Jr. | 206/594 |
| 3,752,301 | 8/1973 | Bluemel . | |
| 4,119,204 | 10/1978 | Peckar . | |
| 4,511,038 | 4/1985 | Miller et al. . | |
| 5,074,416 | 12/1991 | Hustad . | |

*Primary Examiner*—Jacob K. Ackun
*Attorney, Agent, or Firm*—Kenneth S. Watkins, Jr.

[57] ABSTRACT

An environmentally sensible package for delicate items comprises a base and a cover. The package is enclosed by a container such as a corrugated box for shipping. The base of the preferred embodiment comprises a central component cavity suspended by a perimeter portion comprising a cover interlock, a flexible surface, a sloped wall and four independent flanges. The perimeter portion provides necessary vertical and lateral flexibility to the component cavity and provides the vertical clearance required for displacement of the component cavity. The independent flanges reduce transmitted shock to the component cavity by flexing upon impact without transmitting the shock to adjacent flanges through the corner portion.

The package is made of a rigid plastic such as PVC to reduce bulk and make recycling more economical compared to expanded foam packaging. The use of a clear material allows viewing of the protected component when enclosed by the package.

23 Claims, 6 Drawing Sheets

Fig- 5
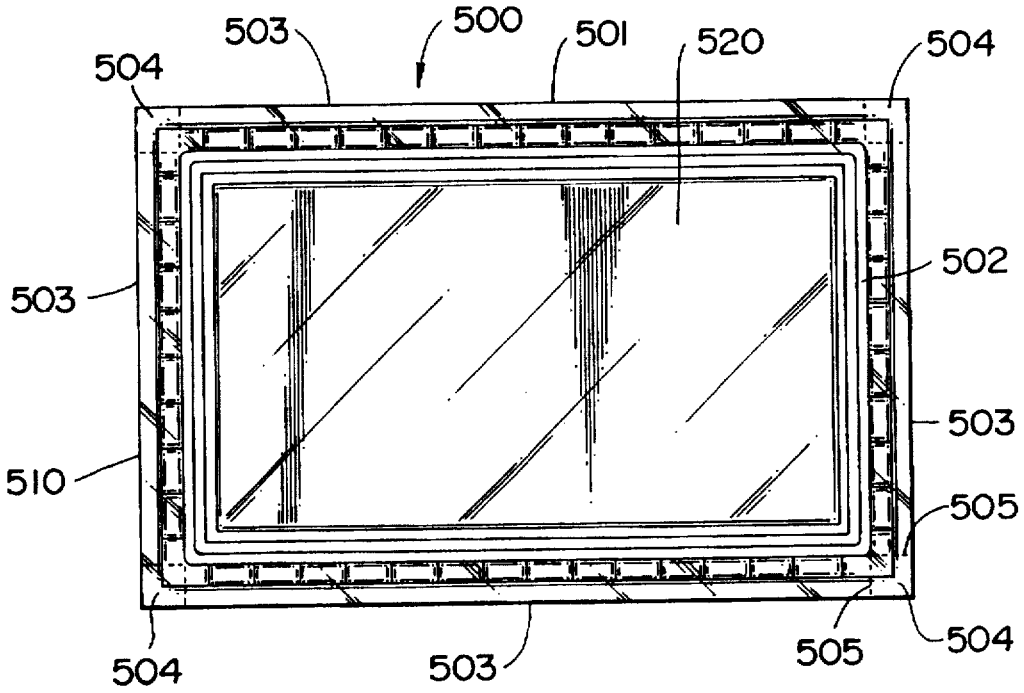
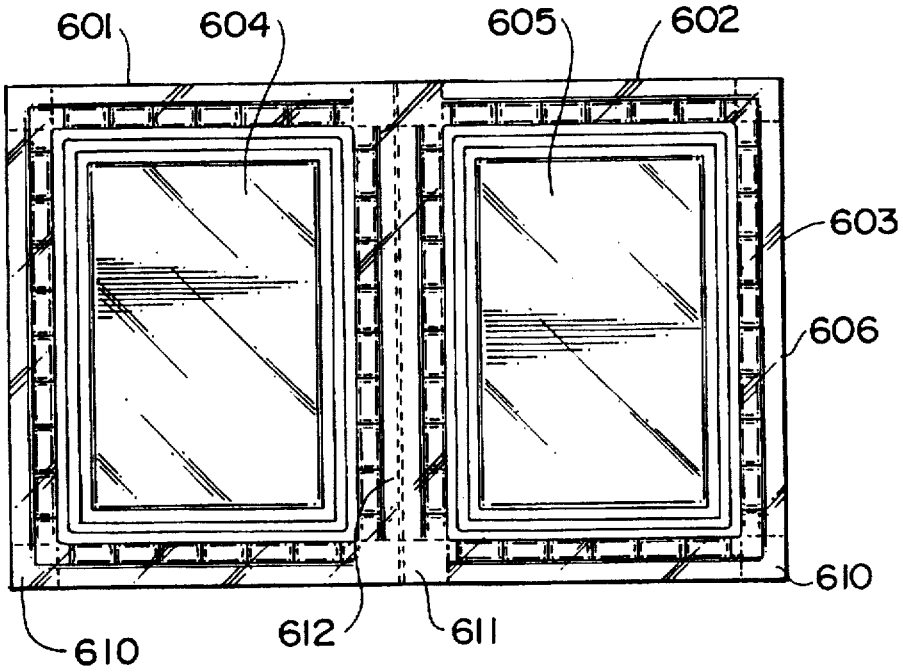
Fig- 6

PROTECTIVE PACKAGE FOR DELICATE ITEMS

This application is a continuation of application Ser. No. 08/422,070, filed Apr. 13, 1995, now abandoned.

BACKGROUND OF THE INVENTION

The present invention relates to shock-resistant packaging and, more particularly, to shock-resistant packaging for shipping in containers such as corrugated containers.

Shock-resistant packaging is required for shipping delicate items, especially electronic equipment such as test instruments, sensors, circuit boards and electronic components. Large circuit boards are often especially difficult to protect in shipping due to their size and weight resulting in difficulties in properly supporting the boards during shipment.

Delicate items must be supported during shipping and protected from excessive acceleration ("G") loads due to shock events occurring during shipping and handling. Packaging must protect the item if the container or box holding the package is dropped on the top/bottom, sides, corners or edges. In addition, the item must be protected from damage from loading effects due to stacking and storage.

Delicate items are often shipped loose in a package containing expanded plastic foam shapes such as the familiar "peanut" or other loose-fill materials. A disadvantage of this type of packaging is that the position of the item to be protected is not controlled. The item may be placed incorrectly or migrate during shipping and handling to an outside portion of the container. Dropping the container on the adjacent surface will transmit excessive "G" loads to the item.

Semi-rigid expanded plastic foam packaging has also been used for shipping delicate items. This packaging may be designed to retain the item in the desired position. However, the semi-rigid nature of the packaging does not allow sufficient deflection during the shock event (i.e. dropping) to provide adequate "G" load reduction.

Expanded plastic foam packaging causes an environmental problem due to the high bulk of the foam, and the limited recycling availability of the product. Opaqueness of expanded foam also prevents viewing the item through the packaging.

Attempts have been made to produce shock-reducing packaging using other materials; U.S. Pat. No. 3,752,301 discloses a shock-proof packaging container comprising an outer carton and a polygonal inner support member which fits snugly within the outer carton. A flexible sling attached to opposing walls suspends the fragile article. U.S. Pat. No. 4,511,031 discloses a three piece container for storing pellicles. The container is made of a transparent thin-walled plastic material. These and other packaging methods have not fully addressed the need for shock protection of delicate items such as computer main boards during shipping, handling and storage.

SUMMARY OF THE INVENTION

Therefore an object of the present invention is to provide a package for delicate items which provides shock protection from top, bottom, side, edge and corner drops which may occur during shipping and handling.

Another object of the present invention is to provide an environmentally sensible package for delicate items which is made of readily recyclable materials and requires little volume for shipping, storage or disposal.

Another object of the present invention is to provide a protective package which supports a large electronic circuit board such as a computer motherboard.

Yet another object of the present invention is to provide a package for delicate items which is transparent so the protected item can be readily observed while retained in the package.

The present invention comprises a package having a base and a cover. The delicate item is retained in a centrally located component cavity in the base. The component cavity is supported by a perimeter portion which comprises flanges forming the outer edges of the base. The flanges are made independent of each other by incorporating flange side edges which are unconnected to adjacent flange side edges. Lateral shock loads, such as those caused by edge, side or corner drops, are attenuated by flexure of the flanges. If the flanges were not made independent, flexure of the flanges would be reduced, limiting the shock attenuation by the flanges.

In the preferred embodiment of the present invention, the perimeter portion of the base comprises a sloped wall between the component cavity and the flanges. The sloped wall extends outward and downward from the base component cavity. The sloped wall provides additional vertical and lateral flexibility to item in the component cavity and provides space for downward motion of the component cavity by ensuring the lowest point on the component cavity is above the lowest point on the perimeter portion. The flanges may have a series of raised portions or steps between the outer portion of the flange and the sloped wall to increase rigidity of the flanges and retain the desired shape of the flanges.

The cover of the preferred embodiment is similar to the base except that the sloped wall extends outward and upward from the cover component cavity. This method ensures the highest point of the cover component cavity is below the highest point of the cover perimeter portion, allowing upward deflection space for the component cavity.

The perimeter portion of the preferred embodiment also comprises a flexible surface surrounding the component cavity to increase vertical flexibility of the component cavity and an interlock on the base and matching interlock on the cover. The interlock and matching interlock cooperate to prevent lateral movement of the cover with respect to the base. A latch may be provided to retain the cover on the base or, alternatively, the latch may be incorporated into the interlock and matching interlock.

The package may be formed from a rectangular sheet of thermoplastic by a process such as vacuum forming. The stepped flanges are made independent by removing a portion of the corners of the sheet during the manufacturing process.

The cover of the package is releasable and may be hinged to the base or may be separate from the base.

BRIEF DESCRIPTION OF THE DRAWINGS

These and other features, aspects, and advantages of the present invention will become better understood with regard to the following description, appended claims and accompanying drawings where:

FIG. 5 is a top plan view of the inverted base of an alternative embodiment showing the process of making the independent stepped flanges;

FIG. 6 is a top plan view of a cover and base made from a single sheet of plastic.

DESCRIPTION OF THE EMBODIMENTS

The following is a detailed description of several embodiments of a package for delicate items.

Figure 1:
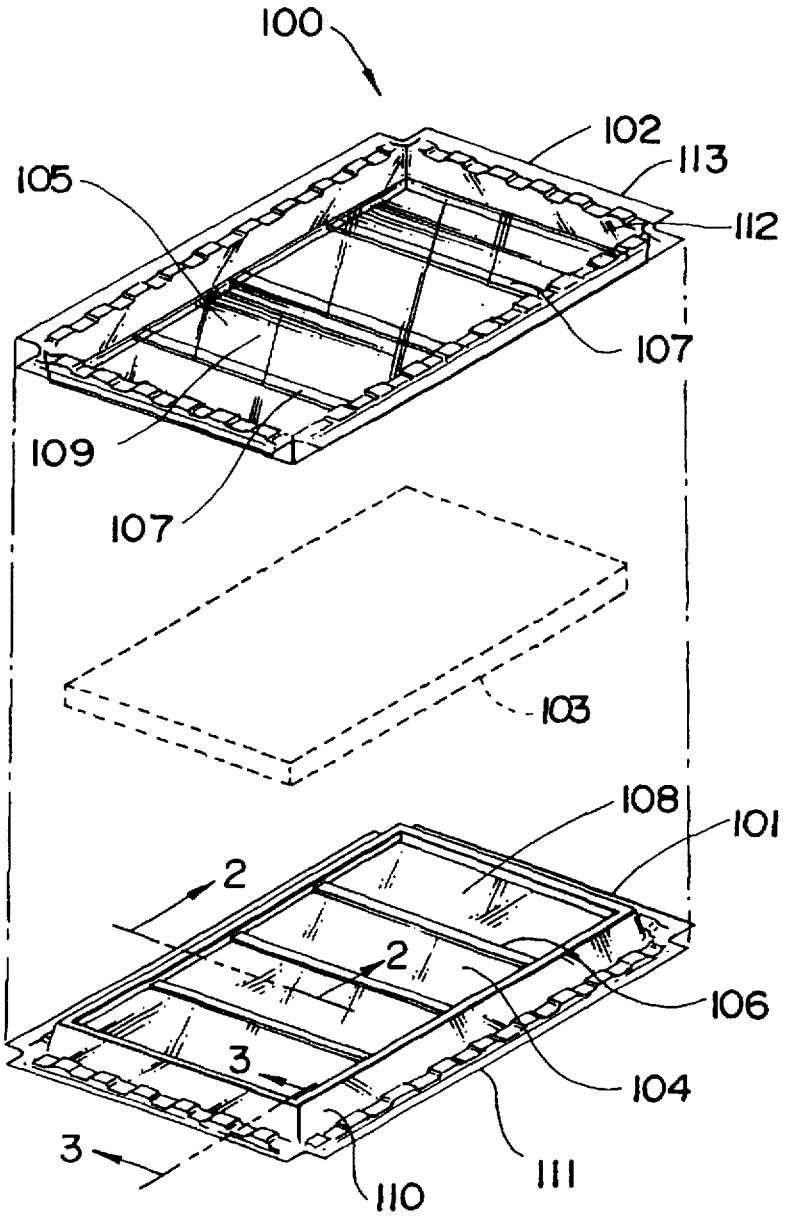
FIG. 1 is a perspective drawing showing assembly of the cover and base of the preferred embodiment to enclose a protected component.

FIG. 1 is a perspective drawing showing the preferred embodiment 100 of the package comprising base 101 and cover 102. Component 103 is retained in package 100 by base component cavity 104 and cover component cavity 105. For large components such as computer main boards, base cavity ribs 106 and cover cavity ribs 107 stiffen the component cavities and prevent excessive flexing of base cavity bottom 108 and cover cavity top 109. Base 101 comprises base sloped walls 110 and base flanges 111 surrounding base cavity 104. Cover 102 comprises cover sloped walls 112 and cover flanges 113 surrounding cover cavity 105, resulting in a rectangular shape to package 100.

Figure 2:
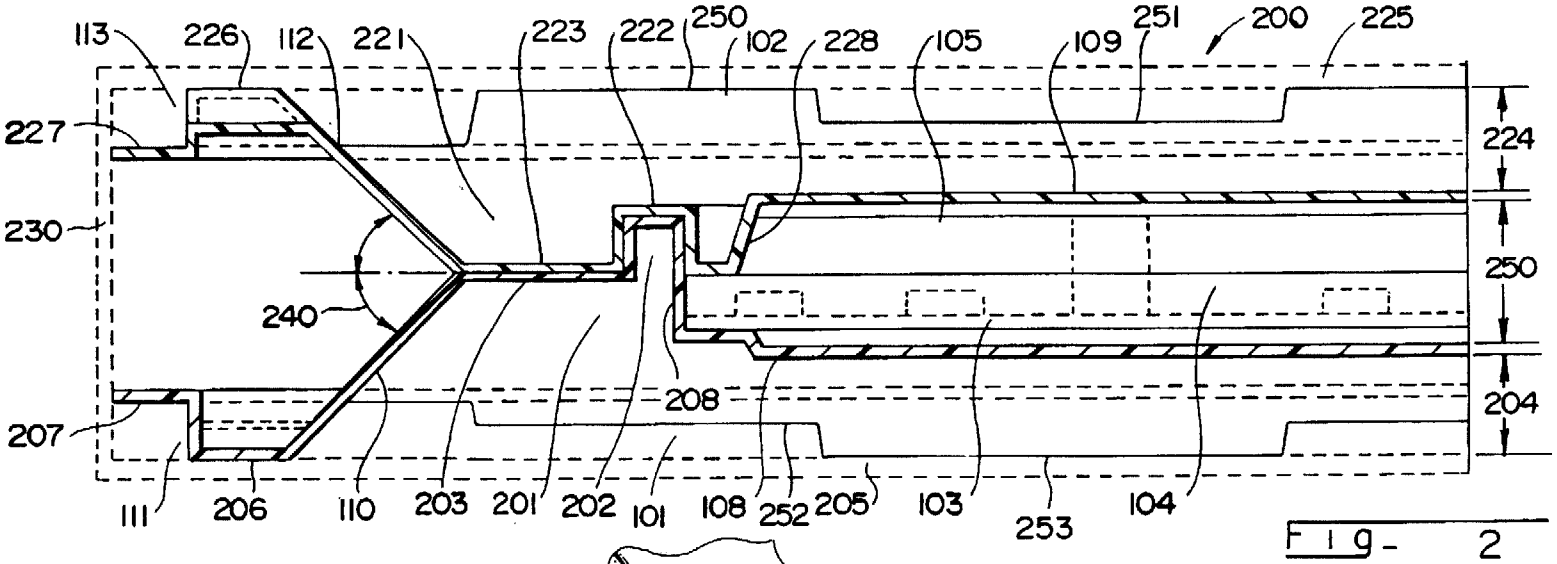
FIG. 2 is a partial front elevation section drawing of the assembled package and component of FIG. 1 in a container, the section plane indicated on base 101 of FIG. 1.

FIG. 2 is a partial cross section of package 100 within container 200 showing base cover 102 engaged to base 101. Component 103 is retained in base component cavity 104 and cover component cavity 105.

Base perimeter portion 201 comprising base interlock 202, base flexible surface 203, base sloped wall 110 and base flange 111 is attached to and supports base cavity side 208 and base cavity bottom 108. Base interlock 202 is an inverted "U"-shaped interlock channel attached to base cavity bottom 108. Interlock 202 engages cover 102 to retain cover 102 to base 101 and to prevent lateral movement of cover 102 with respect to base 101. Base interlock 202 also provides lateral and vertical flexibility to base cavity bottom 108. Base flexible surface 203 is attached to interlock 202 and provides additional vertical flexibility to base cavity bottom 108.

Base sloped wall 110 is attached to flexible surface 203 and slopes downward and outward from base component cavity 104. Sloped wall 110 provides vertical base clearance 204 to allow downward displacement of base cavity bottom 108 without contacting container bottom 205. Base sloped wall 110 also provides additional vertical and lateral flexibility for base cavity bottom 108.

Base flange 111 is attached to base sloped wall 110 and comprises base stepped portion 206 and base flange outer portion 207. The lowest point of base cavity bottom 108 is above the lowest point of perimeter portion 201 by distance 204. Distance 204 represents a maximum amount of downward deflection from a relaxed position in which the base component cavity can move without base cavity bottom 108 contacting container bottom 205.

Cover perimeter portion 221 comprising cover matching interlock 222, cover flexible surface 223, cover sloped wall 112 and cover flange 113 is attached to and supports cover cavity side wall 228 and cover cavity top 109. Cover interlock 222 is a matching inverted "U"-shaped interlock channel attached to cover cavity top 109. Cover interlock 222 engages base interlock 202 in an interference fit to retain cover 102 to base 101 and to prevent lateral movement of cover 102 with respect to base 101. Cover interlock 222 also provides lateral and vertical flexibility to cover cavity top 109. Cover flexible surface 223 is attached to interlock 222 and provides additional vertical flexibility to cover cavity top 109.

Cover sloped wall 112 is attached to flexible surface 223 and slopes upward and outward from cover cavity 105. Cover sloped wall 112 provides vertical cover clearance 224 to allow upward displacement of cover cavity top 109 without contacting container top 225. Cover sloped wall 112 also provides additional vertical and lateral flexibility for cover cavity top 109.

Cover flange 113 is attached to cover sloped wall 112 and comprises cover stepped portion 226 and cover flange outer portion 227. The highest point of cover cavity bottom 109 is below the highest point of the cover perimeter portion 221 by distance 224. Distance 224 represents a maximum amount of upward deflection from a relaxed position in which cover cavity top 109 can move without contacting container top 225.

In the preferred mode of use, package 100 comprising base 101 and cover 102 fits snugly in container 200 with the lowest point (base flange stepped portion 206) of the base perimeter portion 201 in contact with container bottom 205, the highest point (cover stepped portion 226) of cover perimeter portion 221 in contact with container top 225 and base flange outer portion 207 and cover flange outer portion 227 edges in contact with container side 230. Component 103 is retained in package 100 by base cavity side 208, base cavity bottom 108 and cover cavity top 109.

Figure 3:
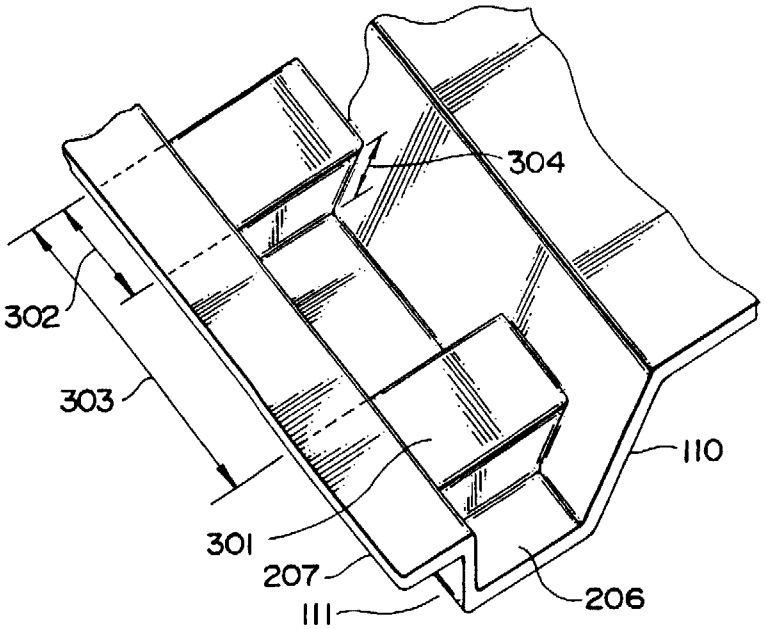
FIG. 3 is a detail perspective section drawing of the base stepped flange of the preferred embodiment, the section plane indicated on base 101 of FIG. 1.

FIG. 3 is a partial perspective section drawing showing the flange construction of base 101 of the preferred embodiment. Base flange steps 301 are formed on base flange stepped portion 206 and extend from base flange outer portion 207 to base sloped wall 110. Base steps 301 maintain the shape of base flange 111 and aid in transmittal of vertical and lateral deflection forces from sloped wall 110 to the container walls (not shown). The step width 302, step spacing 303 and step height 304 are chosen to provide the desired rigidity and force transmission. Increasing the number of steps 301 in flange 111 increases the rigidity of the flange. In the preferred embodiment, step spacing 303 is twice step width 302.

The sequence of extended step portion 250 and retracted step portion 251 of cover 102 is offset from extended step portion 253 and retracted step portion 252 of base 101 in the preferred embodiment shown in FIG. 2. This offset in step sequence allows extended step portion 253 of the base of a second package (not shown) to fit in retracted step portion 251 of the cover 102, resulting in a nested stack arrangement.

Figure 4A:
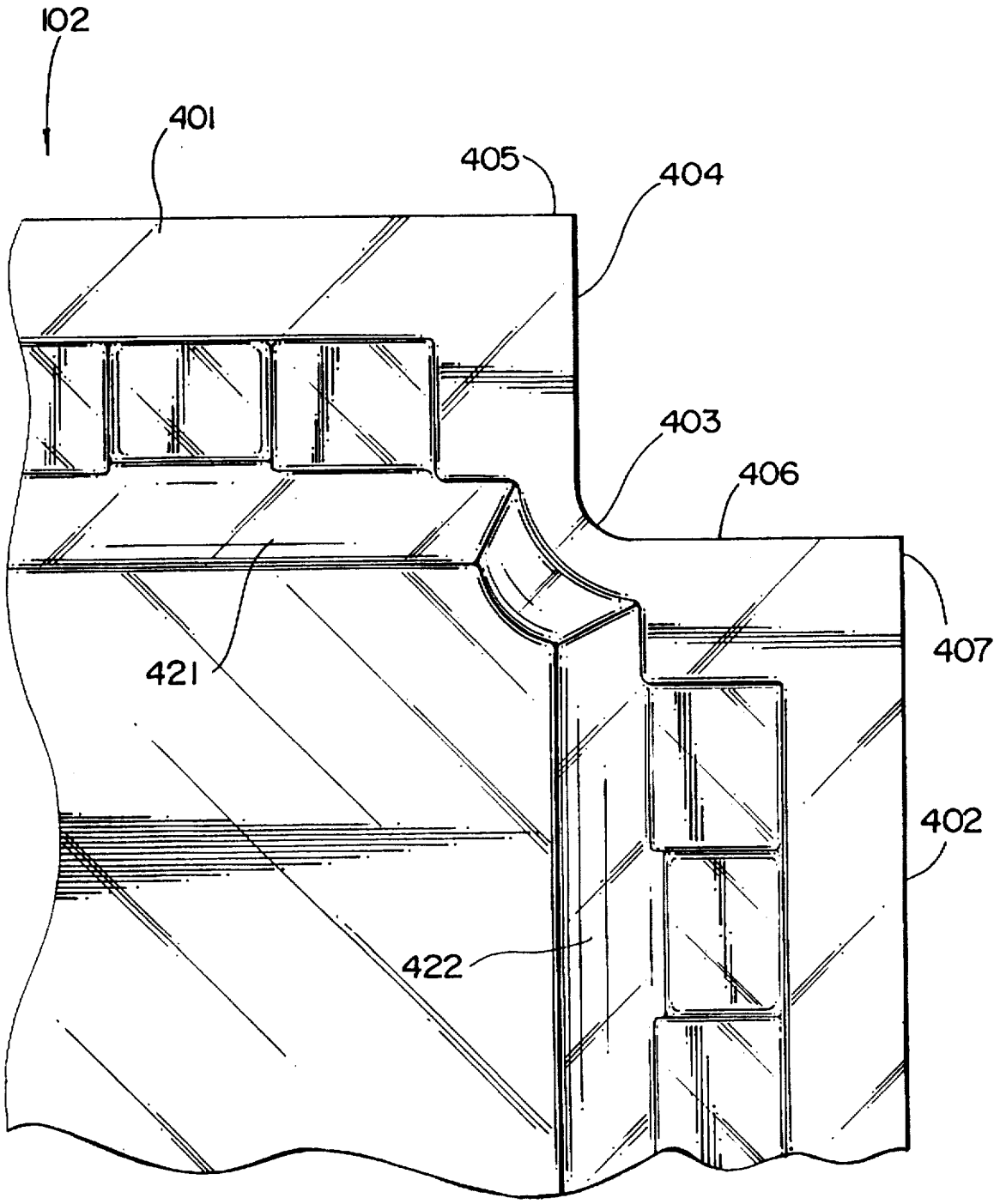
FIG. 4A is a top plan view of the independent flanges of the preferred embodiment.

FIG. 4A is a top plan view of the corner construction of base 101 of the preferred embodiment. First flange 401 is attached to first sloped wall 421 and adjacent second flange 402 is attached to second sloped wall 422. First flange 401 is separated from second flange 402 by inside corner 403. First flange side edge 404 extends from corner 403 to the first outermost point 405 on first flange 401. Second flange side edge 406 is adjacent to first flange side edge 404 and extends from corner 403 to the first outermost point 407 of second flange 402. At least a portion of first flange side edge 404 and second flange side edge 406 are unattached to each other. The unattached side edges result in first flange 401 and second flange 402 flexing independently in the vertical and lateral directions. Independent flexure of the flanges reduces shock transmitted to the component cavity, especially in container edge, side and corner drops. In the preferred embodiment, the four outside flanges of the cover and base are independent flanges.

Figure 4B:
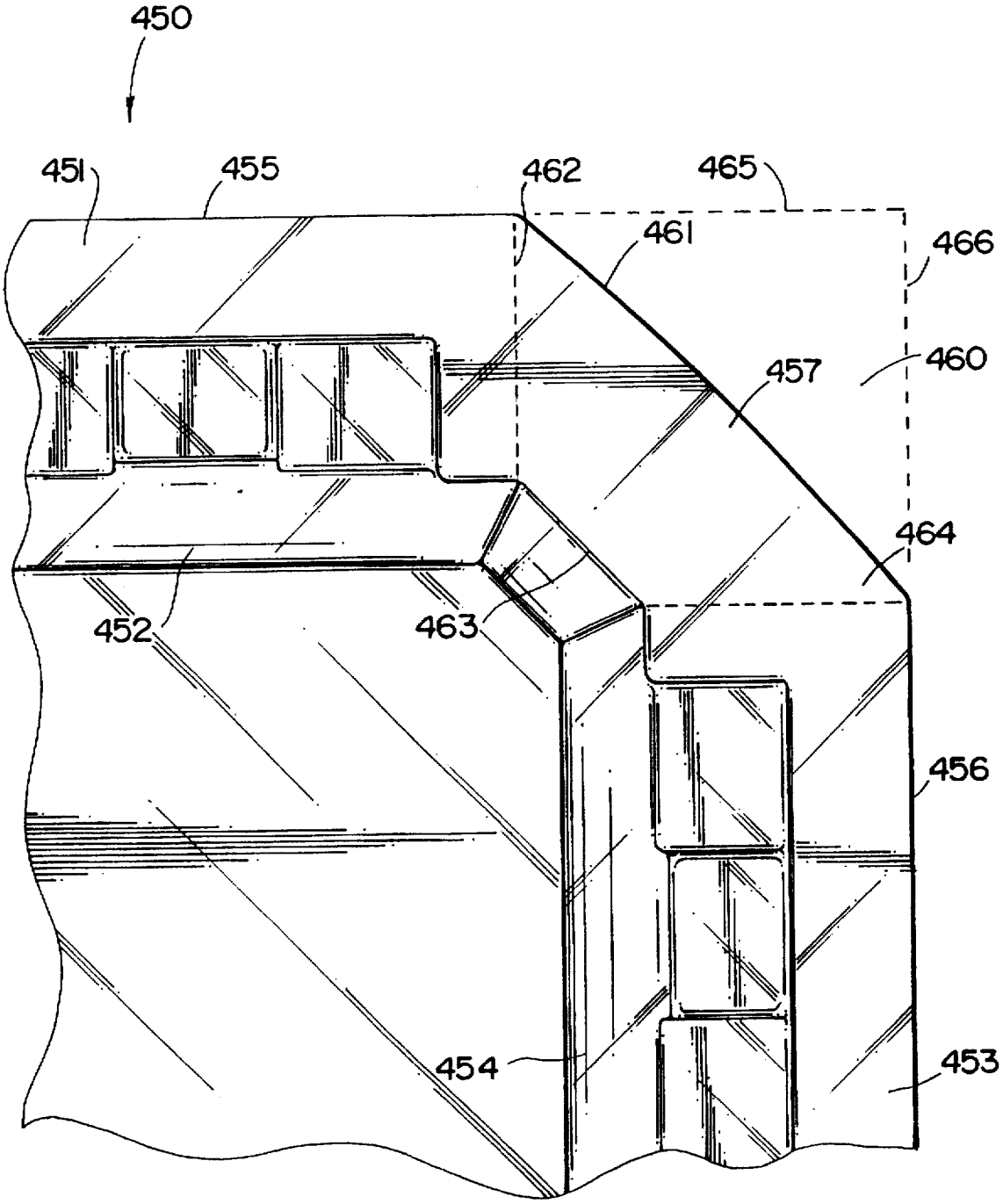
FIG. 4B is a top plan view of the independent stepped flanges of an alternative embodiment of the present invention.

In alternative embodiment 450 shown in FIG. 4B, first stepped flange 451 is connected to first stepped wall 452 and second stepped flange 453 is connected to second sloped wall 454. First flange outer edge 455 is at right angles to second flange outer edge 456. First stepped flange 451 and second stepped flange 453 are adjacent and separated by corner portion 457. Flanges 451 and 453 are made independent by the area of corner portion 457 (area between lines 461,462,463 and 464) being less than corner portion area 460 bounded by the extension of first flange edge 455 and extension second flange edge 456 (area between lines 462, 463, 464, 465 and 466). Steps 470 of flange 451 form a line parallel to flange outer edge 455. Structure interior to the sloped walls in FIGS. 4A and 4B are omitted for clarity.

FIG. 5 shows package embodiment 500 produced by thermally forming the base 501 from a rectangular sheet of plastic 510. The sheet is heated and vacuum formed in a mold producing a base component cavity 520, base sloped walls 502 and four base stepped flanges 503 separated by corner portions 504. Corner portions 504 are removed by a process such as die cutting along flange side edges 505 to produce four base independent flanges such as first flange 401 and second flange 402 of FIG. 4A or first stepped flange 451 and second stepped flange 453 of FIG. 4B. The independent flanges of the base and cover are made in a similar fashion.

Although corner portions 504 are removed after the forming process in the preferred embodiment, they may be removed before the forming process in an alternative process. The plastic sheet may be fed to the forming tools in roll form and die cut before or after forming.

FIG. 6 shows an alternative method of forming base 601 and cover 602 on the same sheet 603. Some perimeter portion details are omitted for clarity. Base cavity 604, cover cavity 605, and flanges 606 are vacuum formed from sheet 603 as previously described. Corner portions 610 and intermediate portions 611 are removed by die cutting to produce the independent flanges as described in FIGS. 4A and 4B. Fold lines 612 form a hinge which allows folding of cover 602 to engage base 601.

Figure 7:
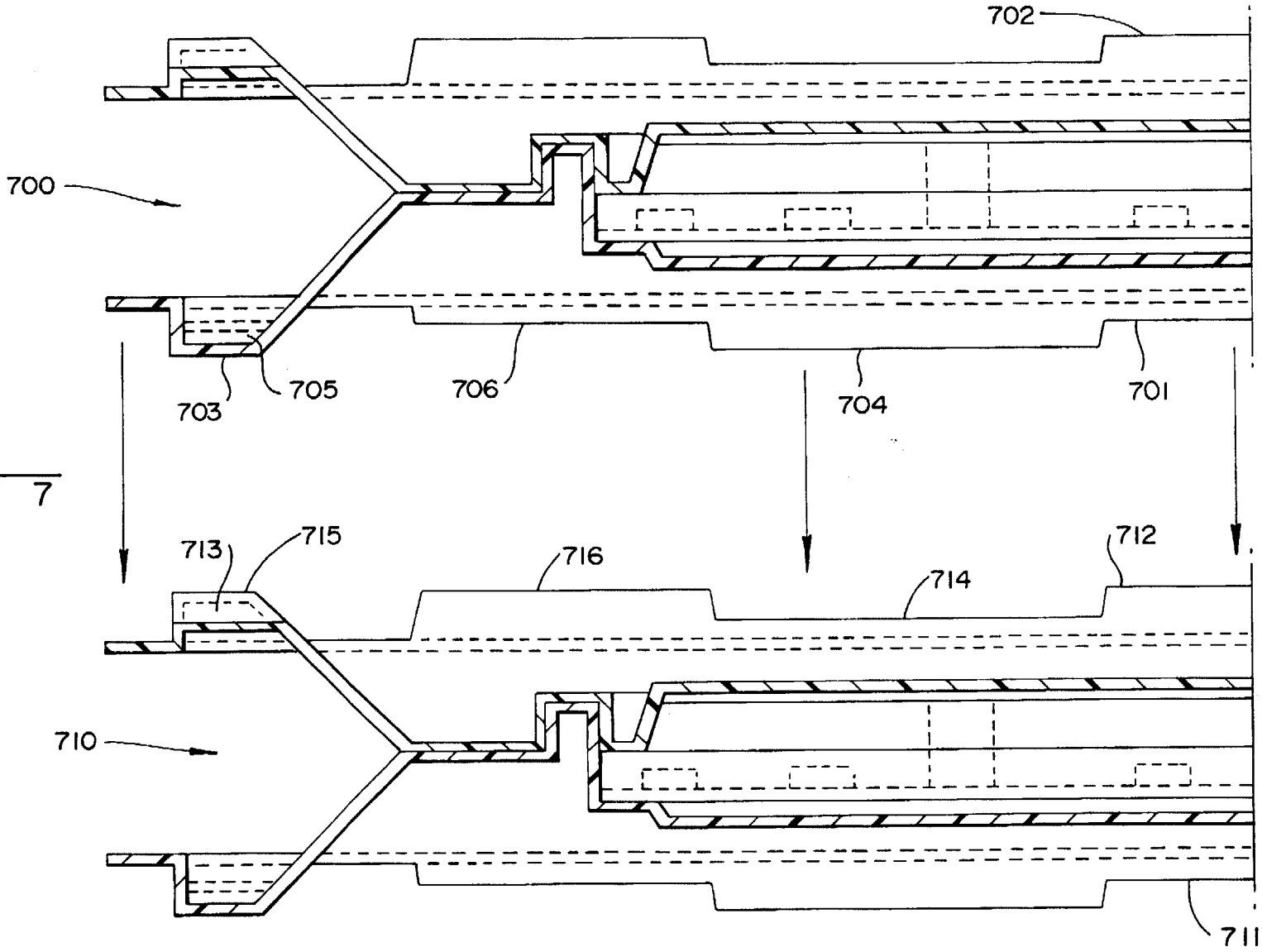
FIG. 7 is a sectional view of two packages being stacked vertically.

FIG. 7 shows package 700 comprising base 701 and cover 702 being stacked on package 710 comprising base 711 and cover 712. Extended step portions 703 and 704 of base 701 engage retracted step portions 713 and 714 of cover 712, and extended step portions 715 and 716 of cover 712 engage retracted step portions 705 and 706 of base 701 to nest package 700 on package 710. The offsetting in sequence of the extended and retracted step portions of the base and cover of the packages allows stable stacking of assembled packages during packaging operations.

Factors affecting the performance of the package include material, material thickness, sloped wall angle, and flange construction. The material used in the preferred embodiment of the package is a rigid transparent plastic such as poly vinyl chloride (PVC). Other plastics can be used including high impact poly styrene (HIPS), poly ethylene (PE), poly propylene (PP), poly ethylene terephthalate (PET(E)), poly ethylene terephthalate glycol (PET(G)) and amorphous poly ethylene terephthalate (APET). The use of a transparent plastic allows visual observation of the protected item when enclosed by the package. The package material 510 of FIG. 5 may incorporate static dissapative or conductive properties, eliminating the need for anti-static or conductive bags or enclosures.

Material thickness is chosen based on material strength and package design. Sheet thickness before forming may be from 0.015" to 0.060". The preferred thickness for packaging for large electronic circuit boards is 0.020" to 0.040".

Sloped wall angle (240 of FIG. 2) is the angle between sloped wall 110 and the horizontal (241 of FIG. 2). Sloped wall angle 240 is chosen to provide adequate vertical base clearance 204 and vertical and lateral flexibility of base cavity bottom 108. Decreasing slope angle 240 generally increases vertical flexibility of base cavity bottom 108 at the expense of package outside dimensions. Sloped wall angle 240 can vary between 20 degrees and 80 degrees with the range of the preferred embodiment 45 degrees to 60 degrees. Base flexible surface 203 width is also chosen to provide adequate vertical flexibility. The sloped wall angle and flexible surface width of the cover are chosen in a similar manner.

Vertical cavity clearances (224 and 204 of FIG. 2.) provide adequate deflection distance for the component cavity for all anticipated shock events. For electronic circuit boards, vertical base clearance 204 and vertical cover clearance 224 are normally chosen to be 1–3 times product thickness (250 of FIG. 2). In the preferred embodiment, vertical clearances (224 and 204) are two times product thickness. Accordingly the reader will see that the package for delicate items provides a two piece package for shock protection of delicate items such as electronic circuit boards and the like. In combination with a container such as a corrugated box, it provides shock protection for the item from top/bottom, side, corner and edge drops. The device provides the following additional advantages:

- the package can be made from a low bulk recyclable plastic;
- the package material can be transparent, allowing viewing of the protected component when contained within the package;
- the packages may be stacked in a nested manner for storage;
- standard sized containers may be used with the packages;
- the package is simple and can be manufactured at low cost; and
- the package material may be made with static-dissapative or conductive properties, eliminating the need for anti-static or conductive bags.

Although the description above contains many specification, these should not be construed as limiting the scope of the invention but as merely providing illustrations of some of the presently preferred embodiments of this invention. For example, the package may be hexagonal or octagonal. Snap type interlocks may be used to secure the cover to the base. The sloped wall may have a curved or "S"-shaped cross section.

Thus the scope of the invention should be determined by the appended claims and their legal equivalents, rather than by the examples given.

I claim:

1. A package for delicate items, the package comprising:

(a) a base comprising a base component cavity and a base perimeter portion, the base perimeter portion surrounding and connected to the base component cavity, the base perimeter portion comprising;

a first base flange comprising a first base side edge, and a second base flange adjacent to the first base flange, the second base flange comprising a second base side edge, the first base side edge and the second base side edge being adjacent and separated by an inside corner and wherein at least a portion of the first base side edge and a portion of the second base side edge are unconnected with each other, the first base flange and the second base flange constructed of a plastic material of predetermined thickness whereby the first base flange flexes in a vertical and a lateral direction independent of the second base flange, and (b) a cover engageable with the base.

2. The package of claim 1 wherein the package is generally rectangular in shape when viewed from above and the first base flange is at right angles to the second base flange.

3. The package of claim 2 wherein the first base flange comprises a plurality of base flange reinforcing steps, the base steps forming a line parallel with an outer edge of the first base flange.

4. The package of claim 3 wherein the base perimeter portion comprises in sequence:

(a) a base flexible surface connected to the base component cavity; and (b) a base sloped wall connected to the base flexible surface and extending downward and outward from the base component cavity, an outer portion of the base sloped wall connected to the first base flange and the second base flange.

5. The package of claim 4 wherein a lowest point of the base component cavity is above a lowest point of the base perimeter portion.

6. The package of claim 5 wherein the cover comprises a cover component cavity surrounded by a cover perimeter portion, the cover perimeter portion connected to the cover component cavity and wherein a highest point of the cover component cavity is below a highest point of the cover perimeter portion.

7. The package of claim 6 comprising a corrugated container, the container comprising a container top, a container bottom and four container sides, the package fitting inside the container with the base perimeter portion retained by the container bottom and container sides and the cover perimeter portion retained by the container sides and container top.

8. A first package according to claim 6 wherein the base steps comprise a first sequence of extended step portions and the cover perimeter portion comprises a cover flange comprising a plurality of cover flange reinforcing steps, the cover steps comprising a second sequence of extended step portions offset from the first sequence of extended step portions wherein base steps of a second package identical with the first package will nest in the cover steps of the first package when the second package is stacked vertically on the first package.

9. The package of claim 6 wherein the base comprises an interlock and the cover comprises a matching interlock, the interlock and the matching interlock cooperating to prevent the cover from moving laterally with respect to the base.

10. The package of claim 9 wherein the base comprises a latch and the cover comprises a matching latch, the matching latch engaging the latch to retain the cover to the base.

11. The package of claim 10 wherein the base component cavity comprises reinforcing ribs.

12. The package of claim 11 wherein the cover and base are separate.

13. The package of clam 11 wherein the cover is hinged to the base.

14. A package for delicate items, the package comprising:

(a) a base, the base comprising a base component cavity and a base perimeter portion, the base perimeter portion surrounding and connected to the base component cavity, the base perimeter portion comprising;

a first base flange and a second base flange, the first base flange and the second base flange being adjacent and separated by an inside corner, the first base flange comprising a first base flange side edge extending from the corner to a first outermost point of the first base flange and the second base flange comprising a second base flange side edge extending from the corner to a first outermost point of the second base flange, wherein at least a portion of the first base flange side edge is unconnected with the second base flange side edge, the first base flange and the second base flange constructed of a plastic material of predetermined thickness whereby the first base flange flexes in a vertical and a lateral direction independent of the second base flange; and (b) a cover engageable with the base.

15. The package of claim 14 wherein the base perimeter portion comprises a base sloped wall between the base component cavity and the first and second base flanges, the base sloped wall connected to the base component cavity and extending outward and downward from the base component cavity, the base sloped wall having a base sloped wall outer portion connected to the first base flange and the second base flange.

16. The package of claim 15 wherein the base perimeter portion comprises a flexible surface between the base component cavity and the base sloped wall, the base flexible surface having a base flexible surface inner portion connected to the base component cavity and a base flexible surface outer portion connected to the base sloped wall.

17. The package of claim 16 wherein the cover comprises a cover component cavity and a cover perimeter portion, the cover perimeter portion surrounding and connected to the cover component cavity.

18. The package of claim 17 wherein a lowest point of the base component cavity is above a lowest point of the base perimeter portion and a highest point of the cover component cavity is below a highest point of the cover perimeter portion.

19. The package of claim 18 comprising a corrugated container, the container comprising a container top, a container bottom and four container sides, the package fitting inside the container with the base perimeter portion retained by the container bottom and container sides and the cover perimeter portion retained by the container sides and container top.

20. A first package according to claim 18 wherein the first base flange comprises a plurality of base flange reinforcing steps comprising a first sequence of extended step portions, the base steps forming a line parallel to an outside edge of the first base flange, and wherein the cover perimeter portion comprises a cover flange, the cover flange comprising a plurality of cover flange reinforcing steps, the cover steps forming a second line parallel to an outside edge of the cover flange, the cover reinforcing steps comprising a second sequence of extended step portions offset from the first sequence of extended step portions wherein base steps of a second package identical to the first package nest in the cover steps of the first package when the second package is stacked vertically on the first package.

21. A package for delicate items, the package insertable in a shipping container, the package comprising:

(a) a base component cavity;

(b) a first base flange connected to the base component cavity by a first base sloped wall, the first base sloped wall sloping down and away from the base component cavity wherein a bottom surface of the first base flange is below a lowest point of the base component cavity, the first base flange comprising a first base flange outside edge;

(c) a second base flange connected to the base component cavity by a second base sloped wall, the second base sloped wall sloping down and away from the base component cavity wherein a bottom surface of the second base flange is below the lowest point of the base component cavity, the second base flange comprising a second base flange outside edge, the second base flange outside edge being perpendicular to the first base flange outside edge, the second base flange adjacent to the first base flange and separated from the first base flange by a base corner portion, the base corner portion comprising a first base corner portion area, the first base corner portion area being less than a second base corner portion area, the second base corner portion area including the first base corner portion area and bounded by an extension of the first base flange outside edge and an extension of the second base flange outside edge; and (d) a cover.

22. The package of claim 21 wherein the cover comprises;

(a) a cover component cavity;

(b) a first cover flange connected to the cover component cavity by a first cover sloped wall, the first cover sloped wall sloping up and away from the cover component cavity wherein a top surface of the first cover flange is above a highest point of the cover component cavity, the first cover flange comprising a first cover flange outside edge; and (c) a second cover flange connected to the cover component cavity by a second cover sloped wall, the second cover sloped wall sloping up and away from the cover component cavity wherein a top surface of the second cover flange is above the highest point of the cover component cavity, the second cover flange comprising a second cover flange outside edge, the second cover flange outside edge being perpendicular to the first cover flange outside edge, the second cover flange adjacent to the first cover flange and separated from the first cover flange by a cover corner portion, the cover corner portion comprising a first cover corner portion area, the first cover corner portion area being less than a second cover corner portion area, the second cover corner portion area including the first cover corner portion area and bounded by an extension of the first cover flange outside edge and an extension of the second cover flange outside edge.

23. The package of claim 22 wherein the base comprises a first engagement member and the cover comprises a second engagement member, the first engagement member engageable with the second engagement member to retain the cover on the base.

* * * * *